US005611095A

United States Patent [19]

Schneider

[11] Patent Number: 5,611,095

[45] Date of Patent: Mar. 18, 1997

[54] MULTI-FUNCTION BABY WRAP

[76] Inventor: Dena Schneider, P.O. Box 1926, Lynnwood, Wash. 98046

[21] Appl. No.: 571,003

[22] Filed: Dec. 12, 1995

[51] Int. Cl.[6] ..... A47G 9/00; A41B 13/06; A41D 15/04

[52] U.S. Cl. ..... 5/482; 2/69

[58] Field of Search ..... 5/655, 482, 417, 5/419, 420; 2/69, 69.5, 89

[56] References Cited

U.S. PATENT DOCUMENTS

| | | | |
|---|---|---|---|
| 1,236,586 | 8/1917 | Milkes | 2/69 |
| 1,274,938 | 8/1918 | Rosenberg | 2/69 |
| 3,034,132 | 5/1962 | Landsberger et al. | 2/69.5 |
| 3,477,065 | 11/1969 | Hoover | 2/69.5 |
| 4,125,903 | 11/1978 | Farrell | 2/69.5 |
| 4,993,090 | 2/1991 | Ranalli | 5/482 |
| 5,243,724 | 9/1993 | Barnes | 5/482 |
| 5,309,586 | 5/1994 | Sies | 5/482 |
| 5,414,881 | 5/1995 | Terrazas | 5/482 |

OTHER PUBLICATIONS

Teddy Toes 800–51–Teddy Copies of advertisement and brochure pages are attached.

*Primary Examiner*—Alexander Grosz
*Attorney, Agent, or Firm*—John H. Wiegenstein

[57] ABSTRACT

This invention relates to a multi purpose baby wrap which converts to a blanket, a bunting, a pad, a fitted wrap, or a shoulder wrap, to provide warmth and/or protection from the elements. A hood (either detachable or integral) may also be provided. It is adaptable for use with a child's car seat (or the like) which is fitted with a restraint system, a front or back carrying pack for carrying infants or toddlers, a stroller or walker, a swing or jumping unit which contains a child, a grocery cart, a high chair, or like equipment in which the infant's legs must be separated.

30 Claims, 2 Drawing Sheets

MULTI-FUNCTION BABY WRAP

I. CROSS REFERENCE TO RELATED APPLICATIONS

Not applicable.

II. STATEMENT AS TO RIGHTS TO INVENTIONS MADE UNDER FEDERALLY SPONSORED RESEARCH AND DEVELOPMENT

Not applicable

III. BACKGROUND OF THE INVENTION

1. Field of the Invention

This invention relates generally to the field of blankets and similar apparatus for wrapping and protecting infants, and more particularly to blankets whose configuration may be readily changed to adapt them for use while the infant is placed in a car seat, stroller, pack, or the like.

2. Description of the Related Art

Modern child car restraint systems, baby carrying packs (both back and front style), strollers, grocery carts, walkers, infant and toddler bicycle seats (which attach to an adult's bicycle), swings and other infant and toddler accessories, are designed to restrain the child's torso, while leaving the head and limbs free to move naturally. Child car seats are particularly important to the health and safety of infants, and are equipped with a restraint system (or harness) which has either three or five anchor points. In a typical three point system, a first restraining member (or harness element) is anchored to the set and extends upward between the child's legs at the crotch. Second and third harness elements are anchored to the backrest portion of the seat and extend over the left and right shoulders of the child. The three harness elements are joined together by one or more suitable buckles or clasps in front of the child's torso. The lengths of the harness elements are adjusted to hold the child's torso tightly in the car seat, while permitting free movement of the head and limbs.

Proper comfort of the child is readily accomplished with the car seat restraint systems and other infant equipment in use today provided the child is clothed in conventional, fitted attire. However, a child that is wrapped in a blanket cannot be properly restrained. It is necessary to remove the blanket from around the child, fasten the harness around the unwrapped child, and then attempt to tuck the blanket over the child and the harness. The blanket cannot provide continuous coverage of the child's shoulders, back and buttocks. Alternatively, if the restraint harness is placed over the blanket in which the child is wrapped, the restraint cannot be properly applied. The crotch harness member cannot be properly positioned between the child's legs, and the child's arms are trapped beneath both blanket and harness.

Similar problems arise when the baby is placed in a front or back pack, stroller, walker, and other carriers which hold the baby in place by means of a member which passes between the baby's legs and supports the baby's weight. These carriers require the use of fitted attire on the baby so that the supporting member can pass between the baby's legs and rest against the baby's crotch.

Various inventors have recognized the need for baby care apparatus to provide a wrap for the use in car seats and similar carriers, which allow for proper restraint as well as warmth and comfort for the infant. For example, U.S. Pat. No. 5,243,724 of Barnes discloses a full size baby blanket, the lower half of which is covered with a large pocket which may be detached from the blanket, which further incorporates a slot for inserting a safety belt for the car seat between the baby's legs when the baby is wrapped in the blanket. The blanket disclosed by Barnes cannot be reconfigured into another type of shawl or wrap, however. The slot or slit arrangement disclosed by Barnes also presents the likelihood of difficulty in routing the seat belt because of misalignment between the blanket and attached pocket which may be expected to occur while the blanket is wrapped around the baby. U.S. Pat. No. 4,125,903 of Farrell likewise discloses a blanket with a pouch or pocket for holding the baby, and outer portions of the blanket which can be folded over the baby. Farrell does not disclose a means for passing a car seat strap through the blanket, and the baby's placement with both legs in a single cavity of the pouch does not allow for arranging such a strap outside the blanket. In addition, Farrell does not disclose any means for securing the outer portions of the blanket around the baby, thus leaving the outer portions free to unfold and expose the baby's upper body when the baby wiggles and moves about.

U.S. Pat. No. 5,309,586 of Sies discloses a blanket which fits over and is secured to the car seat, but does not wrap around the baby and cannot be configured for use on the baby outside of the car seat. U.S. Pat. No. 4,993,090 of Ranalli discloses a blanket that covers a child's car seat and has several apertures through which the restraining belts of the car seat can pass so as to secure the child. The blanket then folds up over the child to keep it warm. It may be seen that the Ranalli blanket must be first placed in the seat and the straps run through it before the baby can be inserted; the baby cannot be wrapped in the blanket and then placed in the car seat.

A product named Teddy Toes (1-800-51-TEDDY) is similar to the Farrell invention, but instead of a pouch uses separate legs for the infant. While this allows use of a car seat restraining strap between the infant's legs, it does not provide a means for securing the outer portions of the blanket around the baby, thus leaving the outer portions free to unfold and expose the baby's upper body when the baby wiggles and moves about. Like the Farrell invention, the Teddy Toes provides one configuration only.

IV. SUMMARY OF THE INVENTION

In view of the foregoing, it is the object of the invention to provide at least the following:

A. A inexpensive wrap for the care, warmth and protection of an infant, which may be readily adapted to one of several configurations so as to serve as a baby blanket, a bunting, a changing or play pad, a wrap for a car seat and other infant holding equipment, and a shoulder blanket.

B. A baby wrap which allows for the wrapping of the child without disturbing the child when placing them in and out of a car seat or any other piece of equipment designed for the use of holding a child, and which allows for the freedom of movement of the arms and hands while still providing a reasonable degree of protection and warmth.

C. A baby wrap which is easily laundered and cleaned, and which will dry quickly.

To achieve these objects, the invention comprises a full-sized infant blanket, with forms of attachments placed strategically in order to form and fold the wrap to adapt it to the various uses described above. Wraps may be produced in a variety of sizes to suit children of different sizes and ages. With the invention a child can first be wrapped in the baby wrap inside the house, and then placed in the car seat and the harness secured. Without adjusting the car seat or other holding device, however, the wrap may be pulled off the shoulders of the child to adjust for temperature differences. In addition, the child can be immediately removed from the car seat without unwrapping the child, and then placed in a front pack, back pack, stroller, grocery cart, swing, etc. These capabilities make the wrap extremely helpful in caring for and transporting an injured or sick infant or toddler, and are of convenience to the parent and child in any case. A hood section may be incorporated to provide additional warmth for the infant's head in cold weather.

V. BRIEF DESCRIPTION OF THE DRAWING(S)

The invention may be better understood by reference to the accompanying drawings.

Figure 1:
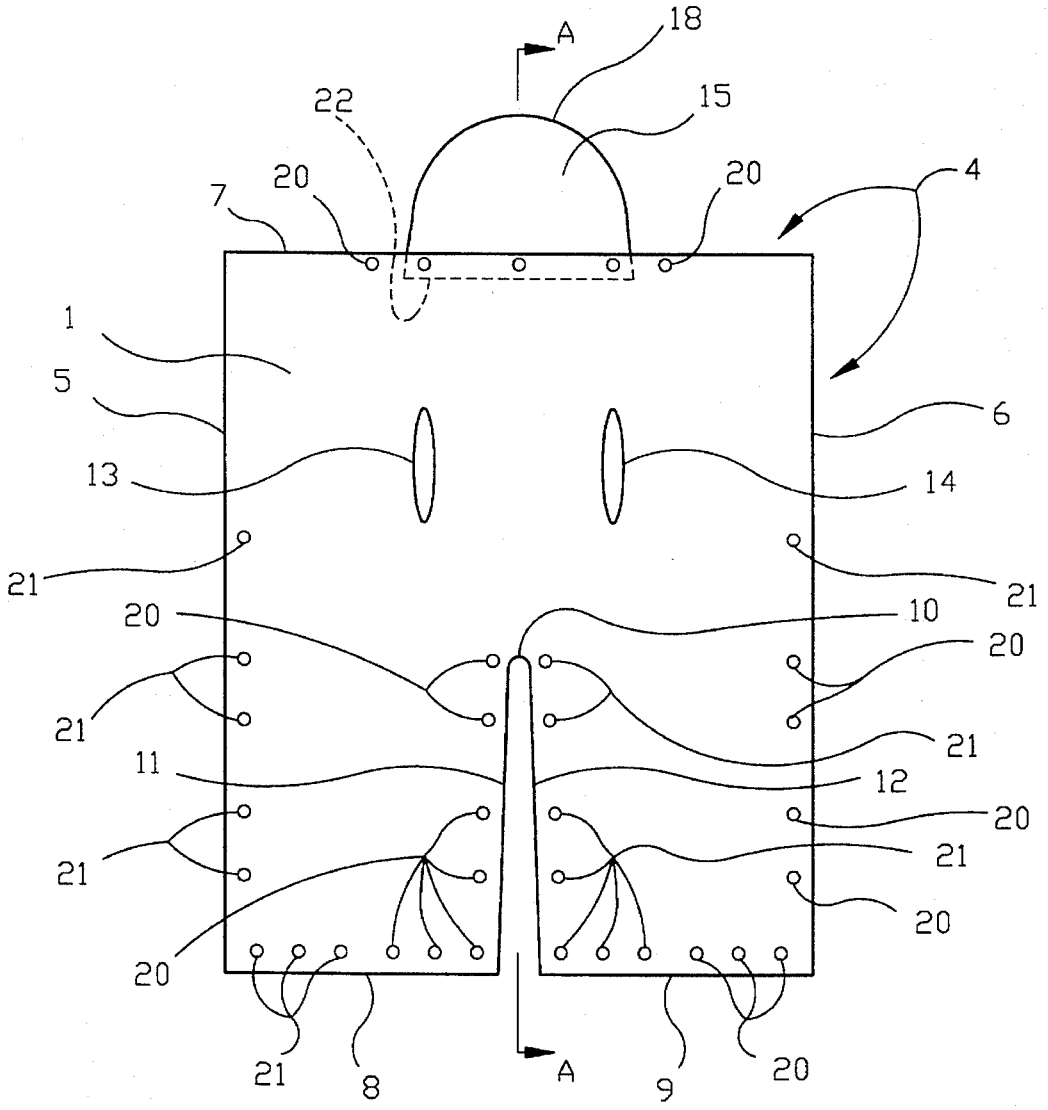
FIG. 1 is a plan view of the multipurpose wrap according to the present invention, with the flexible detachable hood and flexible member laid flat. All temporary fastening means are disengaged except for those which attach the hood to the flexible member.
Figure 3:
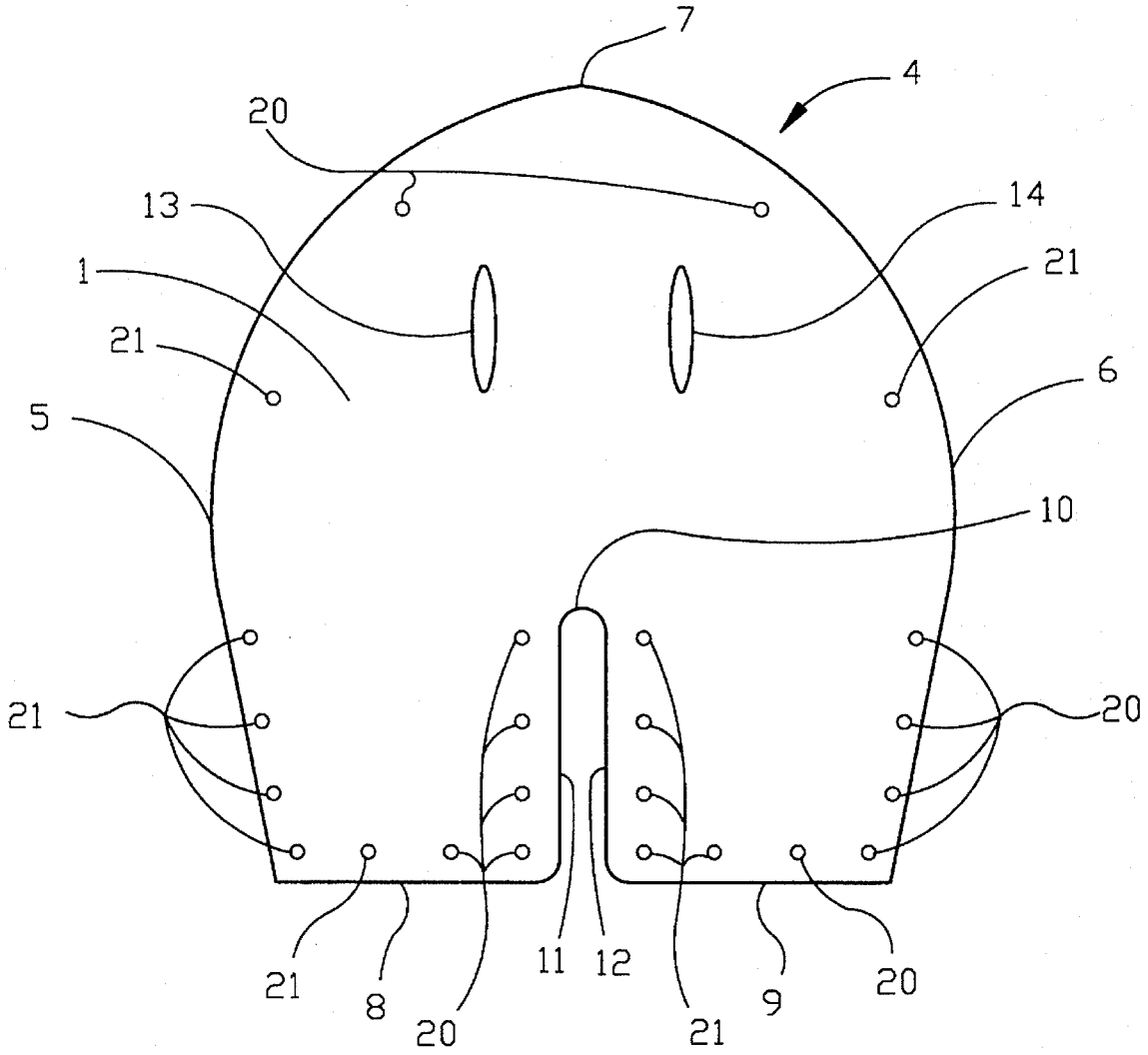

FIG. 3 is the same as FIG. 1, except that the provisions for the detachable hood have been omitted and the shape of the flexible member has been altered to illustrate the variety of geometries which may be used. The number of temporary fastening means has also been varied. No sectional view is indicated.

VI. DESCRIPTION OF THE PREFERRED EMBODIMENT(S)

In the preferred embodiment the invention is comprised of a flexible member 1 having a front side 2, back side 3, a contiguous seamed edge 4, first interior edge 13, and second interior edge 14. The member 1 is preferably down filled cotton fabric, but may be of any fabric typically used for infant clothing or blankets, such as cotton, nylon, Polarfleece™, or the like. Seamed edge 4 further comprises first and second outer segments 5 and 6 generally parallel to each other, upper segment 7, first lower segment 8 and second lower segment 9, an apex 10, first inner segment 11 and second inner segment 12. As may be seen from FIG. 1, in the preferred embodiment apex 10 is a point from one half and two thirds the distance from upper segment 7 to first and second lower segments 8 and 9, and midway between first and second outer segments 5 and 6. First and second inner segments 11 and 12 extend from first and second lower segments 8 and 9 and meet at apex 10. First interior edge 13 and second interior edge 14 define apertures of more or less elliptical shape, with the major axes of the ellipses so formed being more or less parallel to first and second outer segments 5 and 6, respectively, and located and sized so as to allow an infant's arms to pass comfortably from front side 2 to back side 3.

Flexible hood member 15 has a front side 16, a back side 17, and a contiguous seamed hood edge 18. Hood member 15 is preferably constructed of the same material (e.g., down filled cotton) as flexible member 1. Seamed hood edge 18 further comprises a mating segment 22.

A plurality of temporary fastening means 19 are each comprised of first part 20 and second part 21. First part 20 and second part 21 are each permanently affixed to flexible member 1 and engage each other to provide temporary fastening of portions of flexible member 1 to other portions of flexible member 1. First part 20 and second part 21 may likewise be manually disengaged from each other to unfasten flexible member 1. In the preferred embodiment first part 20 and second part 21 are comprised, respectively, of male and female snaps. Some other suitable combinations of first part 20 and second part 21 are, respectively, segments of Velcro™ hook and loop fastener; mating portions of a zipper; button and buttonhole; and toggle and loop.

Figure 2:
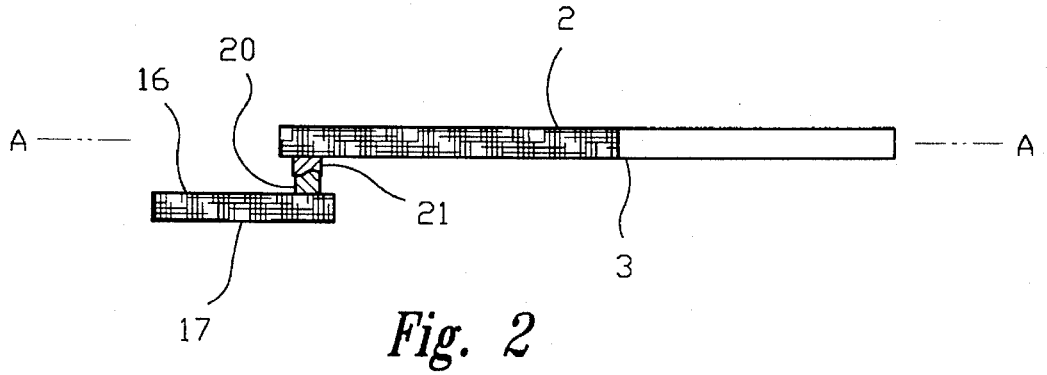
FIG. 2 is a view through section A—A of FIG. 1, showing a partial cross section of the multipurpose wrap, including the attachment of the hood to the flexible member using male and female snaps.

As may be seen in FIG. 1 and FIG. 2, the arrangement of temporary fastening means 19 on flexible member 1 and flexible hood member 15 is as follows.

(a) A plurality of first part 20*s* is attached along first inner segment 11, and a like number of second part 21*s* is attached along second inner segment 12. Spacing of these first part 20*s* and second part 21*s* is such that they can be engaged to each other. When so engaged, flexible member 1 forms an open blanket or wrap. A plurality of second part 21*s* is attached along first outer segment 5, and a like number of first part 20*s* is attached along second outer segment 6. Spacing of these first part 20*s* and second part 21*s* is such that they can be engaged to each other, as well as being engaged to the second part 21*s* and first part 20*s* on the second inner segment 12 and first inner segment 11 respectively. When the second part 21*s* attached along first outer segment 5 are engaged to the first part 20*s* attached along second outer segment 6, the wrap forms a bunting. The infant's arms may or may not be passed through the apertures defined by first interior edge 13 and second interior edge 14, as temperature conditions warrant.

(b) Alternatively, if the second part 21*s* attached along first outer segment 5 are engaged to the first part 20*s* attached along first inner segment 11, and the first part 20*s* attached along second outer segment 6 are engaged to the second part 21*s* attached along second inner segment 12, flexible member 1 forms a fitted wrap with support for the infant's crotch and separate compartments for the infant's legs. Again, the infant's arms may or may not be passed through the apertures defined by first interior edge 13 and second interior edge 14, as temperature conditions warrant.

(c) As another alternative, flexible member 1 may be placed with apex 10 at the nape of the baby's neck and one or more of the first part 20*s* attached along first inner segment attached to a like number of second part 21*s* attached along second inner segment 12. In this configuration the wrap fits securely around the baby's neck to form a cape or shawl, and all other temporary fastening means 19 on flexible member 1 are disengaged.

Thus, temporary fastening means 19 must be of the same type (e.g., snaps) in each of the above locations, so as to permit the multiple configurations described.

(d) A plurality of first part 20*s* and like number of second part 21*s* are attached along each of first lower segment 8 and second lower segment 9. These are arranged so that when first outer segment 5 is attached to first inner segment 11, and second outer segment 6 is attached to second inner segment 12, the first part 20*s* and second part 21*s* on the first lower segment 8 engage each other to close first lower segment 8 against itself and provide a support for the infant's leg. The same arrangement applies to second lower segment 9 so that the same result may be achieved for the infant's other leg. These temporary fastening means 19 need not be of the same type as used in other locations.

(e) A plurality of second part 21*s* are attached along upper segment 7 of flexible member 1, and a like number of first part 20*s* are attached along mating segment 22 of flexible hood member 15. Spacing of these first part 20*s* and second part 21*s* is such that they can be engaged to each other. When so engaged, flexible hood member 15 attaches to flexible member 1 to provide a hood for the infant. This may be achieved with the flexible member 1 arranged in any of the bunting, fitted wrap, or cape/shawl configurations described above.

(f) At least two first part 20*s* are attached along upper segment 7, each disposed between the second part 21*s* attached to upper segment 7 and first and second outer segments 5 and 6, respectively. One or more second part 21*s* are attached along each of first and second outer segments 5 and 6 so that when the wrap is in either the bunting or fitted wrap configurations described above, the first part 20*s* along upper segment 7 may be engaged with the second part 21*s* along the nearer of first and second outer segments 5 and 6, respectively. In this configuration portions of upper segment 7 and adjacent portions of first and second outer segments 5 and 6 form sleeves for covering the infant's arms. These temporary fastening means 19 need not be of the same type as used in other locations.

I claim:

1. A multi-function baby wrap, comprising:

(a) A flexible member having front and back sides and a contiguous edge comprising at least
an upper segment,
first and second outer segments,
a first lower segment extending from the first outer segment to a point no more than one half the distance from the first outer segment to the second outer segment,
a second lower segment extending from the second outer segment to a point no more than one half the distance from the second outer segment to the first outer segment,
an apex located between the first and second lower segments and the upper segment, and further located between the first outer segment to the second outer segment,
a first inner segment extending from the first lower segment to the apex, and
a second inner segment extending from the second lower segment to the apex, (b) a plurality of temporary fastening means permanently affixed to the flexible member, each having a first part which can be engaged and disengaged from a second part, and arranged as follows:
one or more first parts affixed adjacent to the first inner segment, and a like number of second parts affixed adjacent to the second inner segment, spaced so as to allow engagement of each first part with its respective second part so that the first inner segment to becomes temporarily attached to the second inner segment,
one or more second parts affixed to the first outer segment and a like number of first parts affixed to the second outer segment, spaced so as to allow the first outer segment to be temporarily attached to the first inner segment and the second outer segment to be temporarily attached to the second inner segment, and
one or more first parts and a like number of second parts affixed adjacent to the first lower segment, and one or more first parts and a like number of second parts affixed adjacent to the second lower segment, all being spaced so that when the first outer segment is temporarily attached to the first inner segment, and the second outer segment is temporarily attached to the second inner segment, the first parts and second parts on the first lower segment engage each other to close the first lower segment against itself, and the first parts and second parts on the second lower segment engage each other to close the second lower segment against itself.

2. The invention of claim 1, further comprising one or more first parts attached adjacent to the upper segment and one or more additional second parts attached adjacent to each of the first and second outer segments, so that the upper segment may be folded down and attached to the first and second outer segments, in which configuration portions of the upper segment and first and second outer segments form sleeves for the infant's arms.

3. The invention of claim 1, in which the flexible member further comprises a plurality of apertures of size and shape sufficient to allow an infant's arms to pass comfortably from the front side of the fabric member to the back side of the fabric member.

4. The invention of claim 1, further comprising (a) a flexible hood member having front and back sides and a contiguous hood edge comprising at least a mating segment, and (b) a plurality of temporary fastening means permanently affixed to the flexible member and hood member, each having a first part which can be engaged and disengaged from a second part, with one or more first parts affixed adjacent to the mating segment of the flexible hood member and a like number of second parts affixed adjacent to the upper segment of the flexible member, spaced so as to allow engagement of each first part with its respective second part so that the flexible hood member becomes temporarily attached to the flexible member.

5. The invention of claim 4, further comprising one or more first parts attached adjacent to the upper segment and one or more additional second parts attached adjacent to each of the first and second outer segments, so that the upper segment may be folded down and attached to the first and second outer segments, in which configuration portions of the upper segment and first and second outer segments form sleeves for the infant's arms.

6. The invention of claim 4, in which the flexible member further comprises a plurality of apertures of size and shape sufficient to allow an infant's arms to pass comfortably from the front side of the fabric member to the back side of the fabric member.

7. The invention of claim 4, further comprising one or more additional first parts and one or more additional second parts attached adjacent to each of the first and second outer segments, so that the first and second outer segments may be folded down and attached to themselves, in which configuration portions of the first and second outer segments form sleeves for the infant's arms.

8. The invention of claim 4, further comprising one or more additional first parts and one or more additional second parts attached adjacent to each of the first and second outer segments, so that a portion of the first outer segment may be folded down and attached to a portion of the second outer segment, and a portion of the second outer segment folded down and attached to a portion of the first outer segment, in which configuration portions of the first and second outer segments form sleeves for the infant's arms.

9. The invention of claim 1, in which the upper segment is proportioned so as to form an integral hood to cover the infant's head.

10. The invention of claim 9, further comprising one or more first parts attached adjacent to the upper segment and one or more additional second parts attached adjacent to each of the first and second outer segments, so that the upper segment may be folded down and attached to the first and second outer segments, in which configuration portions of the upper segment and first and second outer segments form sleeves for the infant's arms.

11. The invention of claim 9, in which the flexible member further comprises a plurality of apertures of size and shape sufficient to allow an infant's arms to pass comfortably from the front side of the fabric member to the back side of the fabric member.

12. The invention of claim 9, further comprising one or more additional first parts and one or more additional second parts attached adjacent to each of the first and second outer segments, so that the first and second outer segments may be folded down and attached to themselves, in which configuration portions of the first and second outer segments form sleeves for the infant's arms.

13. The invention of claim 9, further comprising one or more additional first parts and one or more additional second parts attached adjacent to each of the first and second outer segments, so that a portion of the first outer segment may be folded down and attached to a portion of the second outer segment, and a portion of the second outer segment folded down and attached to a portion of the first outer segment, in which configuration portions of the first and second outer segments form sleeves for the infant's arms.

14. The invention of claim 1, further comprising one or more additional first parts and one or more additional second parts attached adjacent to each of the first and second outer segments, so that the first and second outer segments may be folded down and attached to themselves, in which configuration portions of the first and second outer segments form sleeves for the infant's arms.

15. The invention of claim 1, further comprising one or more additional first parts and one or more additional second parts attached adjacent to each of the first and second outer segments so that a portion of the first outer segment may be folded down and attached to a portion of the second outer segment, and a portion of the second outer segment folded down and attached to a portion of the first outer segment, in which configuration portions of the first and second outer segments form sleeves for the infant's arms.

16. A multi-function baby wrap, comprising:

(a) A flexible member having front and back sides and a contiguous edge comprising at least
an upper segment,
first and second outer segments,
a first lower segment extending from the first outer segment to a point no more than one half the distance from the first outer segment to the second outer segment,
a second lower segment extending from the second outer segment to a point no more than one half the distance from the second outer segment to the first outer segment,
an apex located between the first and second lower segments and the upper segment, and further located between the first outer segment to the second outer segment,
a first inner segment extending from the first lower segment to the apex, and
a second inner segment extending from the second lower segment to the apex, (b) a plurality of temporary fastening means permanently affixed to the flexible member, each having a first part which can be engaged and disengaged from a second part, and arranged as follows:
one or more first parts affixed adjacent to the first inner segment, and one or more first parts affixed adjacent to the second inner segment,
one or more second parts affixed to the first outer segment, and one or more second parts affixed to the second outer segment, spaced so as to allow the first outer segment to be temporarily attached to the first inner segment and the second outer segment to be temporarily attached to the second inner segment, and
one or more first parts and a like number of second parts affixed adjacent to the first lower segment, and
one or more first parts and a like number of second parts affixed adjacent to the second lower segment, all being spaced so that when the first outer segment is temporarily attached to the first inner segment, and the second outer segment is temporarily attached to the second inner segment, the first parts and second parts on the first lower segment engage each other to close the first lower segment against itself, and the first parts and second parts on the second lower segment engage each other to close the second lower segment against itself.

17. The invention of claim 16, further comprising one or more first parts attached adjacent to the upper segment and one or more additional second parts attached adjacent to each of the first and second outer segments, so that the upper segment may be folded down and attached to the first and second outer segments, in which configuration portions of the upper segment and first and second outer segments form sleeves for the infant's arms.

18. The invention of claim 16, in which the flexible member further comprises a plurality of apertures of size and shape sufficient to allow an infant's arms to pass comfortably from the front side of the fabric member to the back side of the fabric member.

19. The invention of claim 16, further comprising (a) a flexible hood member having front and back sides and a contiguous hood edge comprising at least a mating segment, and (b) a plurality of temporary fastening means permanently affixed to the flexible member and hood member, each having a first part which can be engaged and disengaged from a second part, with one or more first parts affixed adjacent to the mating segment of the flexible hood member and a like number of second parts affixed adjacent to the upper segment of the flexible member, spaced so as to allow engagement of each first part with its respective second part so that the flexible hood member becomes temporarily attached to the flexible member.

20. The invention of claim 19, further comprising one or more first parts attached adjacent to the upper segment and one or more additional second parts attached adjacent to each of the first and second outer segments, so that the upper segment may be folded down and attached to the first and second outer segments, in which configuration portions of the upper segment and first and second outer segments form sleeves for the infant's arms.

21. The invention of claim 19, in which the flexible member further comprises a plurality of apertures of size and shape sufficient to allow an infant's arms to pass comfortably from the front side of the fabric member to the back side of the fabric member.

22. The invention of claim 19, further comprising one or more additional first parts and one or more additional second parts attached adjacent to each of the first and second outer segments, so that the first and second outer segments may be folded down and attached to themselves, in which configuration portions of the first and second outer segments form sleeves for the infant's arms.

23. The invention of claim 19, further comprising one or more additional first parts and one or more additional second parts attached adjacent to each of the first and second outer segments, so that a portion of the first outer segment may be folded down and attached to a portion of the second outer segment, and a portion of the second outer segment folded down and attached to a portion of the first outer segment, in which configuration portions of the first and second outer segments form sleeves for the infant's arms.

24. The invention of claim 16, in which the upper segment is proportioned so as to form an integral hood to cover the infant's head.

25. The invention of claim 24, further comprising one or more first parts attached adjacent to the upper segment and one or more additional second parts attached adjacent to each of the first and second outer segments, so that the upper segment may be folded down and attached to the first and second outer segments, in which configuration portions of the upper segment and first and second outer segments form sleeves for the infant's arms.

26. The invention of claim 24, in which the flexible member further comprises a plurality of apertures of size and shape sufficient to allow an infant's arms to pass comfortably from the front side of the fabric member to the back side of the fabric member.

27. The invention of claim 23, further comprising one or more additional first parts and one or more additional second parts attached adjacent to each of the first and second outer segments, so that the first and second outer segments may be folded down and attached to themselves, in which configuration portions of the first and second outer segments form sleeves for the infant's arms.

28. The invention of claim 24, further comprising one or more additional first parts and one or more additional second parts attached adjacent to each of the first and second outer segments, so that a portion of the first outer segment may be folded down and attached to a portion of the second outer segment, and a portion of the second outer segment folded down and attached to a portion of the first outer segment, in which configuration portions of the first and second outer segments form sleeves for the infant's arms.

29. The invention of claim 16, further comprising one or more additional first parts and one or more additional second parts attached adjacent to each of the first and second outer segments, so that the first and second outer segments may be folded down and attached to themselves, in which configuration portions of the first and second outer segments form sleeves for the infant's arms.

30. The invention of claim 16, further comprising one or more additional first parts and one or more additional second parts attached adjacent to each of the first and second outer segments, so that a portion of the first outer segment may be folded down and attached to a portion of the second outer segment, and a portion of the second outer segment folded down and attached to a portion of the first outer segment, in which configuration portions of the first and second outer segments form sleeves for the infant's arms.

* * * * *